US008794737B2

(12) United States Patent
Taira et al.

(10) Patent No.: US 8,794,737 B2
(45) Date of Patent: Aug. 5, 2014

(54) INKJET PRINTING APPARATUS AND CONTROL METHOD FOR RESTORE UNIT

(75) Inventors: Hiroshi Taira, Inagi (JP); Kiichiro Takahashi, Yokohama (JP); Akiko Maru, Tokyo (JP); Tsukasa Doi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 354 days.

(21) Appl. No.: 13/169,462

(22) Filed: Jun. 27, 2011

(65) Prior Publication Data

US 2011/0316906 A1 Dec. 29, 2011

(30) Foreign Application Priority Data

Jun. 29, 2010 (JP) ..... 2010-148077

(51) Int. Cl.
*B41J 2/165* (2006.01)

(52) U.S. Cl.
USPC ..... 347/23; 347/30

(58) Field of Classification Search
CPC ..... B41J 2002/16573; B41J 2/1652
USPC ..... 347/23, 30, 33
See application file for complete search history.

(56) References Cited

U.S. PATENT DOCUMENTS

| | | | | |
|---|---|---|---|---|
| 5,475,404 | A | 12/1995 | Takahashi et al. | |
| 6,109,724 | A | 8/2000 | Takahashi et al. | |
| 6,227,646 | B1 | 5/2001 | Yano et al. | |
| 6,338,539 | B1 * | 1/2002 | Kobayashi et al. | 347/23 |
| 6,612,683 | B2 | 9/2003 | Takahashi et al. | |
| 6,719,400 | B2 | 4/2004 | Inui et al. | |
| 6,786,566 | B2 * | 9/2004 | Shindo | 347/30 |
| 7,399,046 | B2 | 7/2008 | Teshigawara et al. | |
| 7,445,309 | B2 | 11/2008 | Ide et al. | |
| 7,673,959 | B2 | 3/2010 | Maru et al. | |
| 7,794,044 | B2 | 9/2010 | Yoshikawa et al. | |
| 7,997,681 | B2 | 8/2011 | Yoshikawa et al. | |
| 2009/0051725 | A1 | 2/2009 | Ide et al. | |
| 2011/0148965 | A1 | 6/2011 | Taira et al. | |

FOREIGN PATENT DOCUMENTS

| | | |
|---|---|---|
| JP | 2005-178334 A | 7/2005 |
| JP | 2008-062450 A | 3/2008 |

OTHER PUBLICATIONS

Jan. 14, 2014 Japanese Office Action in Japanese Patent Application No. 2010-148077.

* cited by examiner

*Primary Examiner* — Julian Huffman
(74) *Attorney, Agent, or Firm* — Fitzpatrick, Cella, Harper & Scinto

(57) ABSTRACT

An inkjet printing apparatus is provided that is capable of suppressing an increase in discarded ink by a restore operation of a restore unit. The apparatus is an inkjet printing apparatus that prints an image using a print head having a plurality of ejecting ports for ejecting ink and includes a restore unit that restores the ink ejection function of the print head, and a control unit that controls the restore unit so as to perform a restore operation depending on a parameter involving a growth rate of air bubbles existing inside the print head that is filled with ink.

15 Claims, 13 Drawing Sheets

| SHIPPING FLAG | |
|---|---|
| DRY | FILLED |
| D = 0 | D = 1 |

FIG.9

| TOTAL NUMBER OF TIMES TIMER SUCTION HAS BEEN PERFORMED N | ELAPSED TIME SINCE PREVIOUS TIMER SUCTION Tn | SUCTION TYPE |
|---|---|---|
| N = 0 | 0 | Fn |
| N ≧ 1 | 240 | A |

FIG.10

| TOTAL NUMBER OF TIMES TIMER SUCTION HAS BEEN PERFORMED N | ELAPSED TIME SINCE PREVIOUS TIMER SUCTION Td1 | SUCTION TYPE |
|---|---|---|
| N = 0 | 0 | Fd1 |
| N = 1 | 24 | G1 |
| N = 2 | 72 | G1 |
| N = 3 | 120 | G1 |
| N = 4 | 180 | G1 |
| N = 5 | 240 | G1 |
| N ≧ 6 | 240 | A |

FIG.11

| SUCTION TYPE | NO. OF ROTATIONS OF PG MOTOR | ROTATIONAL SPEED OF PG MOTOR | NUMBER OF TIMES SUCTION IS PERFORMED |
|---|---|---|---|
| Fn | 3000 | 1500 | 3 |
| Fd1 | 5000 | 2500 | 3 |
| Fd2 | 4000 | 2000 | 3 |
| G1 | 3000 | 1500 | 2 |
| G2 | 2000 | 1250 | 1 |
| A | 1000 | 1000 | 1 |

FIG.12

| TOTAL NUMBER OF TIMES TIMER SUCTION HAS BEEN PERFORMED N | ELAPSED TIME SINCE PREVIOUS TIMER SUCTION Td1 | SUCTION TYPE | AIR BUBBLE GROWTH PERIOD FLAG |
|---|---|---|---|
| N = 0 | 0 | Fd1 | H = 1 |
| N = 1 | 24 | G1 | H = 1 |
| N = 2 | 72 | G1 | H = 1 |
| N = 3 | 120 | G1 | H = 1 |
| N = 4 | 180 | G1 | H = 1 |
| N = 5 | 240 | G1 | H = 1 |
| N ≧ 6 | 240 | A | H = 0 |

FIG.14

| MANUAL SUCTION | BEFORE CONVERSION | AFTER CONVERSION |
|---|---|---|
| STRONG | Fd1 | Fd1 |
| WEAK | A | G1 |

FIG.15

| TOTAL NUMBER OF TIMES TIMER SUCTION HAS BEEN PERFORMED N | ELAPSED TIME SINCE PREVIOUS TIMER SUCTION Td2 | SUCTION TYPE | AIR BUBBLE GROWTH PERIOD FLAG |
|---|---|---|---|
| N = 0 | 0 | Fd2 | H = 1 |
| N = 1 | 24 | G2 | H = 1 |
| N = 2 | 72 | G2 | H = 1 |
| N = 3 | 180 | G2 | H = 1 |
| N = 4 | 240 | G2 | H = 1 |
| N ≧ 5 | 240 | A | H = 0 |

FIG.16

| MANUAL SUCTION | SHIPPING FLAG | BEFORE CONVERSION | AFTER CONVERSION |
|---|---|---|---|
| STRONG | 1 | Fd1 | Fd1 |
| | 2 | Fd2 | Fd2 |
| WEAK | 1 | A | G1 |
| | 2 | A | G2 |

FIG.17

INKJET PRINTING APPARATUS AND CONTROL METHOD FOR RESTORE UNIT

BACKGROUND OF THE INVENTION

1. Field of the Invention

The present invention relates to an inkjet printing apparatus and a control method for restore unit thereof.

2. Description of the Related Art

The form of an inkjet printing apparatus in which the print head is installed in the main printing apparatus at the manufacturing plant beforehand and shipped as a product is known. Japanese Patent Laid-Open No. 2005-178334 discloses the form of a printing apparatus in which the print head is installed beforehand and shipped as a product, and after the product has arrived at the user site, a restore process is performed for restoring the ink ejection function of the print head.

As described above, the state inside the print head when shipped from the factory may be a state in which, instead of being filled with ink, may be empty and dry. When the same restore operation is performed for print heads having different states such as this, there is a possibility that the ink ejection function will not be restored, or that the amount of ink that will be discarded will increase.

SUMMARY OF THE INVENTION

One object of the present invention is to provide a control method for an inkjet printing apparatus and restore unit that is capable of suppressing the occurrence of improper ink ejection, as well as suppressing an increase in discarded ink due to a suction restore operation.

The printing apparatus according to the present invention is an inkjet printing apparatus for printing using a print head having a plurality of ejection ports for ejecting ink, and includes: a restore unit configured to restore ink ejection function of the print head; and a control unit configured to control the restore unit so as to perform a restore operation depending on at least one parameter, wherein the at least one parameter involving a growth rate of air bubbles existing inside the print head that is filled with ink.

According to the present invention, performing a restore operation of the restore unit depending on at least one parameter that has an effect on the growth rate of air bubbles makes it possible to optimize the restore operation, so that an increase in the amount of ink discarded by the restore operation can be suppressed.

Further features of the present invention will become apparent from the following description of exemplary embodiments (with reference to the attached drawings).

BRIEF DESCRIPTION OF THE DRAWINGS

FIG. 9 is an ink filling judgment table when a print head is shipped;

FIG. 10 is a suction table for a filled print head;

FIG. 11 is a suction table for a dry print head;

FIG. 12 is a table indicating types of suction;

FIG. 14 is a table of initial bubble growth periods for a dry print head;

FIG. 15 is a suction type conversion table for the initial bubble growth period;

FIG. 16 is a suction table for a dry print head when the manufacturing process and distribution are different; and FIG. 17 is a suction type conversion table for the initial bubble growth period when the manufacturing process and form of transport are different.

DESCRIPTION OF THE EMBODIMENTS

Figure 2:
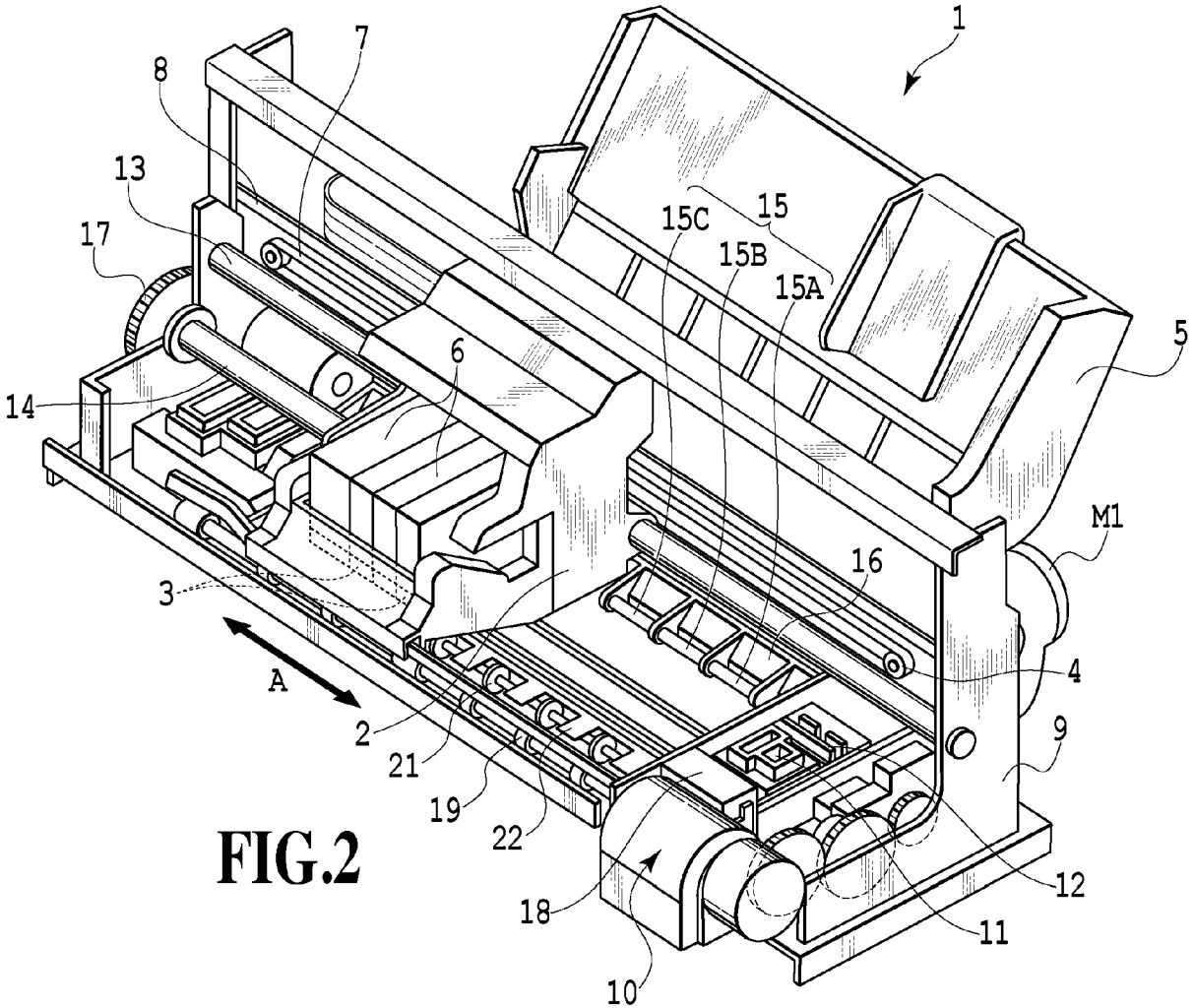
FIG. 2 is an exterior perspective view of an inkjet printing apparatus to which the present invention can be applied.

In the following, embodiments of the present invention will be explained in detail with reference to the accompanying drawings. The same reference numbers will be used in each of the drawings to indicate parts that are the same or that correspond. FIG. 2 is a schematic perspective view illustrating an embodiment of an inkjet type printing apparatus to which the present invention has been applied. In FIG. 2, the printing apparatus 1 comprises: a carriage 2 that moves and in which a print head 3 is installed; a drive motor M1 and a transmission mechanism 4 for moving the carriage 2 back-and-forth in the directions indicated by the arrows A; a paper feed mechanism 5 that feeds a printing medium such as printing paper; and a restore apparatus (restore unit) 10 for performing an eject restore process (continuous restore and maintenance of the ink ejection function) for the print head 3.

In the printing apparatus 1, while controlling the movement (main scanning) of the carriage 2, the recording head 3 is driven based on an image signal, and by conveying (sub scanning) the printing medium that is fed from the paper feed mechanism 5, printing is performed on the printing medium. A print head 3 and ink cartridge 6 are mounted in the carriage 2 such that they are removable. Ink that is stored inside the ink cartridge 6 is supplied to the print head 3. In this case, the required electrical connection between the carriage 2 and print head 3 can be achieved by properly bringing the junction surfaces of each into contact.

By applying pulse voltages that correspond to a printing signal (image signal), the print head 3 prints an image by selectively discharging ink droplets from a plurality of ejection ports. Moreover, the print head 3 comprises an electrothermal converter that generates thermal energy for discharging ink according to the applied pulse voltages. Furthermore, the print head 3 grows bubbles by film boiling that is caused by the thermal energy applied from the electrothermal converter, and using the change in pressure that occurs due to contraction, ejects ink droplets from the ejection ports. A separate electrothermal converter is provided for each of a plurality of ejection ports, and by applying pulse voltages to the electrothermal converters that correspond to a printing signal, ink droplets are ejected from ejection ports that correspond to the electrothermal converters.

The restore apparatus (restore unit) 10 for continuous restore of the ink ejection function of the print head 3 is located at a specified position within the range of movement of the carriage 2 and outside the area to be printed. The restore apparatus 10 comprises: a capping mechanism 11 for covering the ejection ports 49 of the print head 3; a wiping mechanism 12 for wiping and cleaning the ejection port surfaces 23 of the print head 3; a blade cleaning mechanism 18 for cleaning the wiping blade of the wiping mechanism 12, and a suction mechanism 48 (FIG. 3, FIG. 4) having a suction pump that is connected to the capping mechanism 11.

Figure 3:
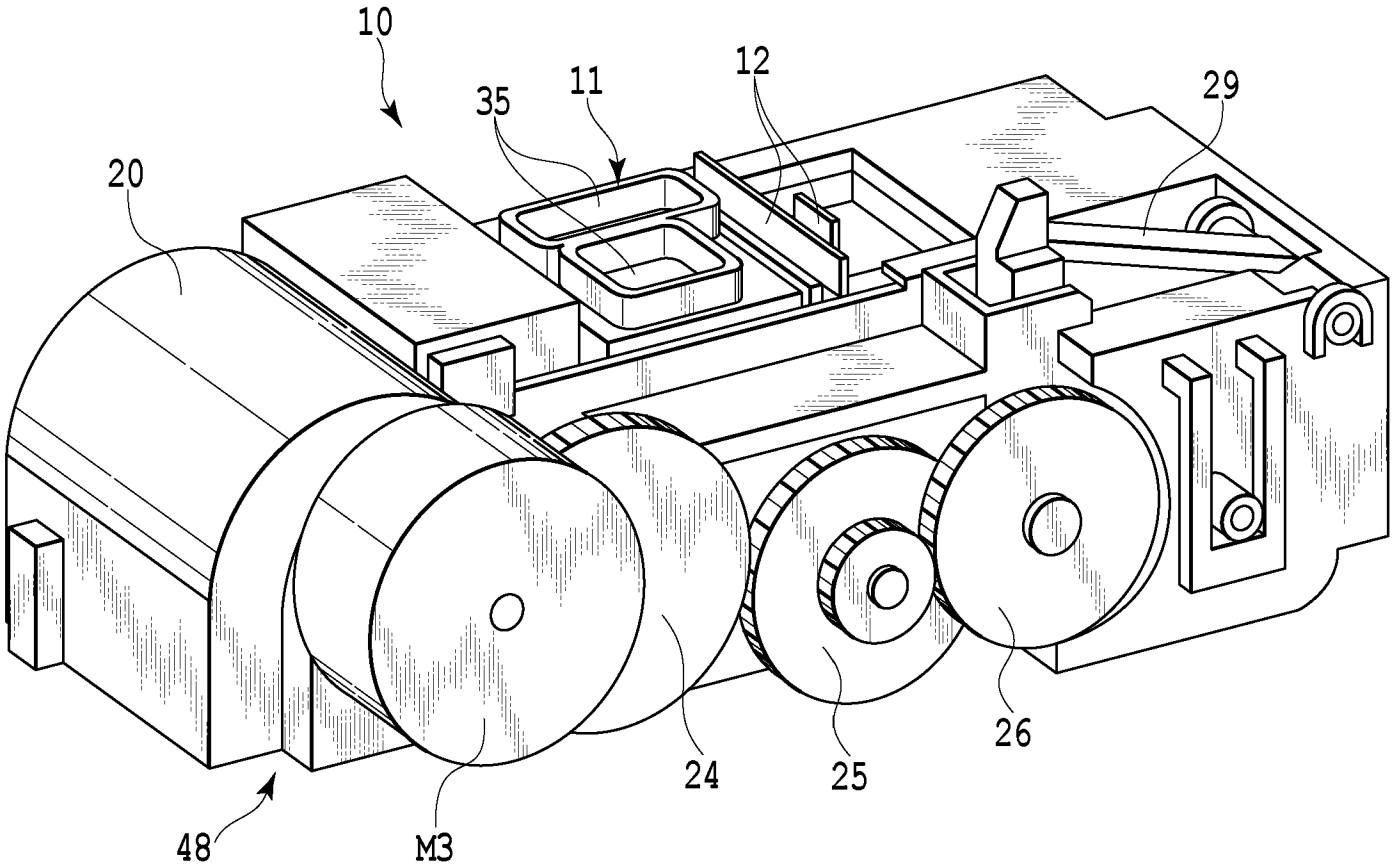
FIG. 3 is a schematic perspective view illustrating an example of the restore unit in the inkjet printing apparatus in FIG. 2.
Figure 4:
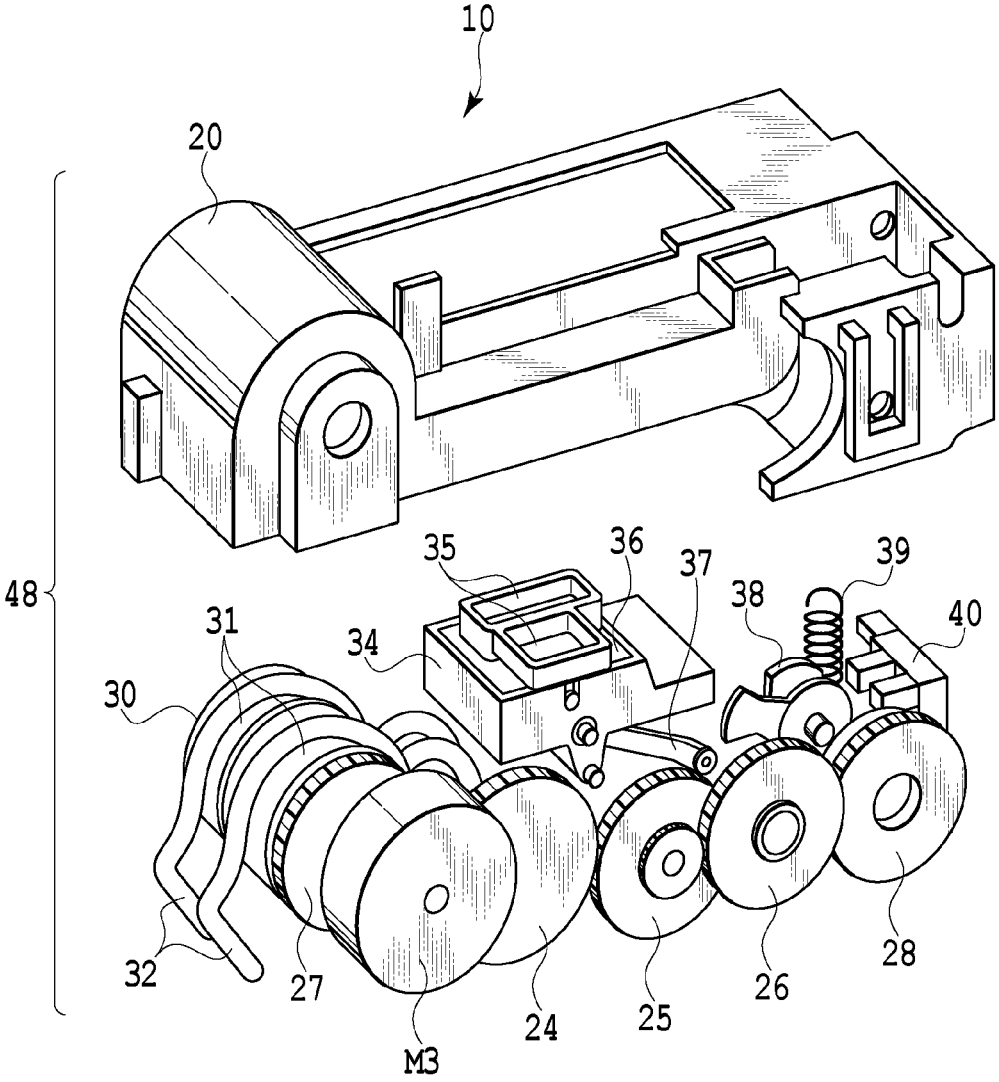
FIG. 4 is a schematic exploded perspective view illustrating the internal construction of the restore unit in FIG. 3.
Figure 5:
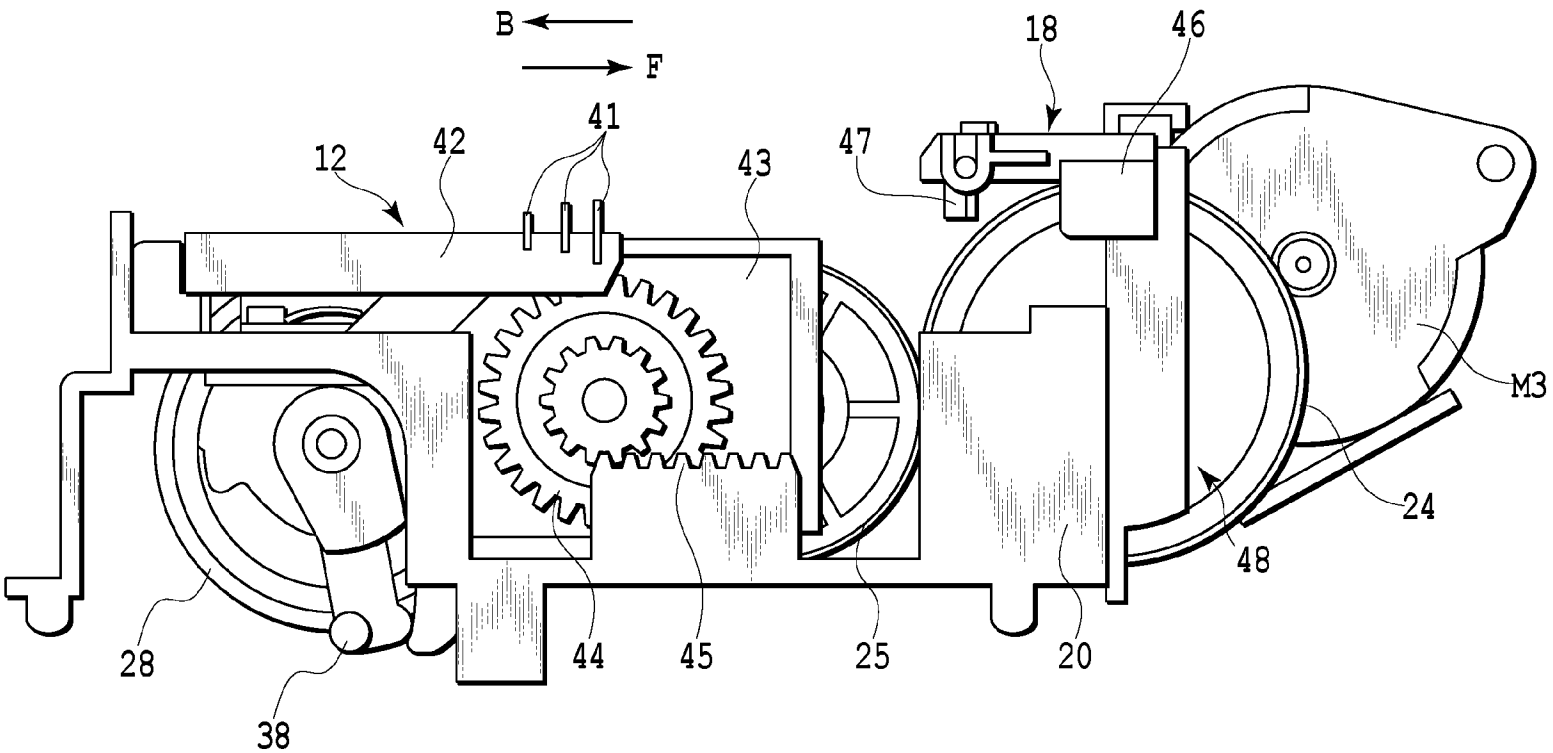
FIG. 5 is a side view illustrating the construction of the wiping mechanism and blade cleaning mechanism in FIG. 3.

FIG. 3 is a schematic perspective drawing illustrating an embodiment of the restore apparatus in the printing apparatus in FIG. 2, FIG. 4 is a schematic exploded perspective drawing illustrating the internal construction of the restore apparatus in FIG. 3, and FIG. 5 is a schematic side view illustrating the construction of the wiping mechanism and blade cleaning mechanism of the restore apparatus in FIG. 3. In order to restore the ink ejection function of the print head 3, the restore apparatus 10 comprises a suction mechanism 48, a capping mechanism 11, a wiping mechanism 12 and a blade cleaning mechanism 18.

In FIG. 3 to FIG. 6 by driving the suction mechanism 48 with the ejection ports 49 closed by the capping mechanism 11, ink can be forcibly sucked out from the ejection ports 49 and a suction restore process can be performed to refresh the ink inside the ejection ports 49. In other words, by performing this kind of suction restore process and removing thick ink and air bubbles from inside the print head 3 together with ink via the ejection ports 49, continuous restore of the ink ejection function of the print head 3 is possible. Moreover, by capping the print head 3 by the capping mechanism 11 when not printing, it is possible to protect the print head 3, as well as prevent the ink inside the ejection ports 49 from drying.

In FIG. 3 to FIG. 5, a tube pump (suction mechanism) 48 comprises two suction tubes 32 that are arranged so that with the inner surface of the arc section of the restore base 20 acting as a guide surface, the tubes 32 run along that arc surface. In addition, the tube pump 48 comprises a pressure roller 33 (not illustrated in the figure) that is pressed against these suction tubes 32, and by rolling while squeezing the tubes, generates a negative pressure inside the suction tubes 32. The pressure roller 33 is arranged so that when pressed against the suction tubes 32 by a pressure spring (not illustrated in the figures) strokes the suction tubes 32 by rolling along the suction tubes 32.

The pressure roller 33 is supported so that it can move along a long groove that is formed in a pressure roller holder 31, and during the suction operation, is forced to the side that presses the suction tubes 32, and at times other than the suction operation can move away from the suction tubes 32. In this embodiment, there are two such pressure rollers 33 for each suction tube 32, for a total of four pressure rollers 33. The pressure roller holder 31 that supports the pressure roller 33 is axially supported by a pressure roller holder guide 30 so that it can rotate in the radial direction of the arc guide surface of the restore base 20, and moves so as to press the pressure rollers 33 against the suction tubes 32, or to move the pressure rollers 33 away from the suction tubes 32. The pressure roller holder guide 30 has shafts on both end sections that are supported such that the pressure roller holder guide 30 is coaxial with the center of the arc of the semi-arc guide surface of the restore base 20 to which the suction tubes 32 are installed, and is arranged so that it can rotate in order to transmit the driving power from the drive motor (hereafter, referred to as the PG motor) M3 of the restore apparatus 10.

The driving power from the PG motor M3 to the suction mechanism 48 is first transmitted to a PG gear 24, then is transmitted to a pump gear 27 that is axially supported by the rotating shaft of the pressure roller holder guide 30. The suction mechanism 48 is formed so that it is directly connected with the drive shaft of the PG motor M3, and is such that it performs the suction operation as the PG motor M3 rotates in one direction (positive direction), and performs the operation to separate the pressure rollers 33 from the suction tubes 32 when the PG motor M3 rotates in the opposite direction (reverse rotation). The rotating position of a cam 38 is set by a flag for a cam position detection sensor that is provided in the cam 38, and a cam position detection sensor 40 that is provided in the restore apparatus, and each restore mechanism is controlled based on the rotating position of the cam 38. Slits (not illustrated in the figure) are provided in the cam 38, and the number of rotations of the motor is controlled by specifying a number of slits.

Figure 6:
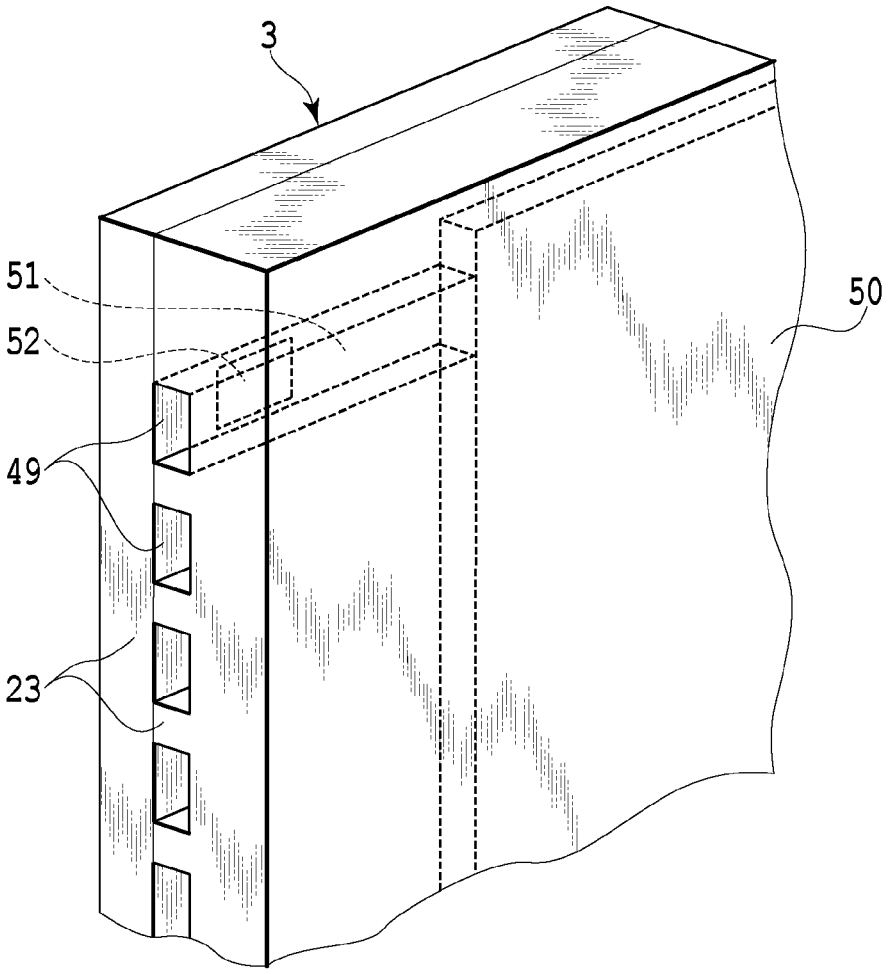
FIG. 6 is a partial perspective view that schematically illustrates the construction of one ink ejection port array of the print head in FIG. 2.

The capping mechanism 11 includes a cap 35, a cap suction member (not illustrated in the figures), a cap holder 36, a cap base 34 and a capping mechanism raising lever 37. The cap 35 comes in contact with the ejection port surface 23 of the print head 3. The cap suction member sucks up and collects the ink that is emitted from the ejection ports 49 of the print head 3 (FIG. 6). The cap holder 36 supports the cap 35 and is pressed by a cap spring (not illustrated in the figures) in the direction of pressing the cap 35 against the ejection port surface 23. The cap base 34 supports the cap spring that applies a capping pressure to the cap holder 36, and supports the cap holder 36 so that it can freely slide in the vertical direction. The capping mechanism raising lever 37 has an arm member for bringing the cap 35 in contact with or separating the cap 35 from the eject port surface 23 of the print head 3.

The wiping mechanism 12 wipes away and removes ink droplets, paper dust and the like that adheres to the ejection port surface 23 of the print head 3. This wiping mechanism 12 is located near the capping mechanism 11. When the wiper blade 41 (FIG. 5) of the wiping mechanism 12 wipes and cleans the ejection port surface 23 of the print head 3, ink, paper dust and the like is transferred to the wiper blade 41, and through repetitive wiping, the transferred matter may be transferred again to the print head 3. It is necessary to prevent as much as possible this kind of re-transfer of ink, paper dust and the like to the print head 3. Therefore, it is necessary to clean (refresh) the wiper blade 41 by scraping or wiping away ink and the like that is transferred to the wiper blade 41. In order for this, a blade cleaning mechanism 18 for cleaning the wiper blade 41 is provided in the restore apparatus 10 of this embodiment. The restore apparatus 10 in the printing apparatus in FIG. 2 continuously restores the ink ejection function of the print head 3 to a proper state by suitably combining a capping mechanism 11, wiping mechanism 12, blade cleaning mechanism 18 and suction mechanism 48 (FIG. 3 to FIG. 5).

FIG. 6 is a partial perspective view that schematically illustrates the construction of the ink eject unit (one ejection port array) of the print head 3. In FIG. 6, an ejection port array having a plurality of ejection ports 49 that are arranged in a row at a specified pitch is formed on the ejection port surface 23 that faces the printing material such as printing paper through a specified space (for example, about 1.0 mm). An electrothermal converter (a heating element) 52 for generating thermal energy for discharging ink is located on the wall surface of each fluid path that connects the common fluid chamber 50 and each ejection port 49. The print head 3 is guided and supported in a positional relationship such that the plurality of ejection ports 49 are aligned in the direction that crosses the main scanning direction (in this embodiment in which the print head 3 is installed in the carriage 2, the direction of movement of the carriage 2; the direction of both arrows A). The print head 3 drives the corresponding electrothermal converters 52 (applies pulse voltage) based on an image signal or eject signal, causes film boiling of the ink inside the fluid paths 51, and causes ink to be ejected from the ejection ports 49 by the pressure that is generated at that time.

Figure 7:
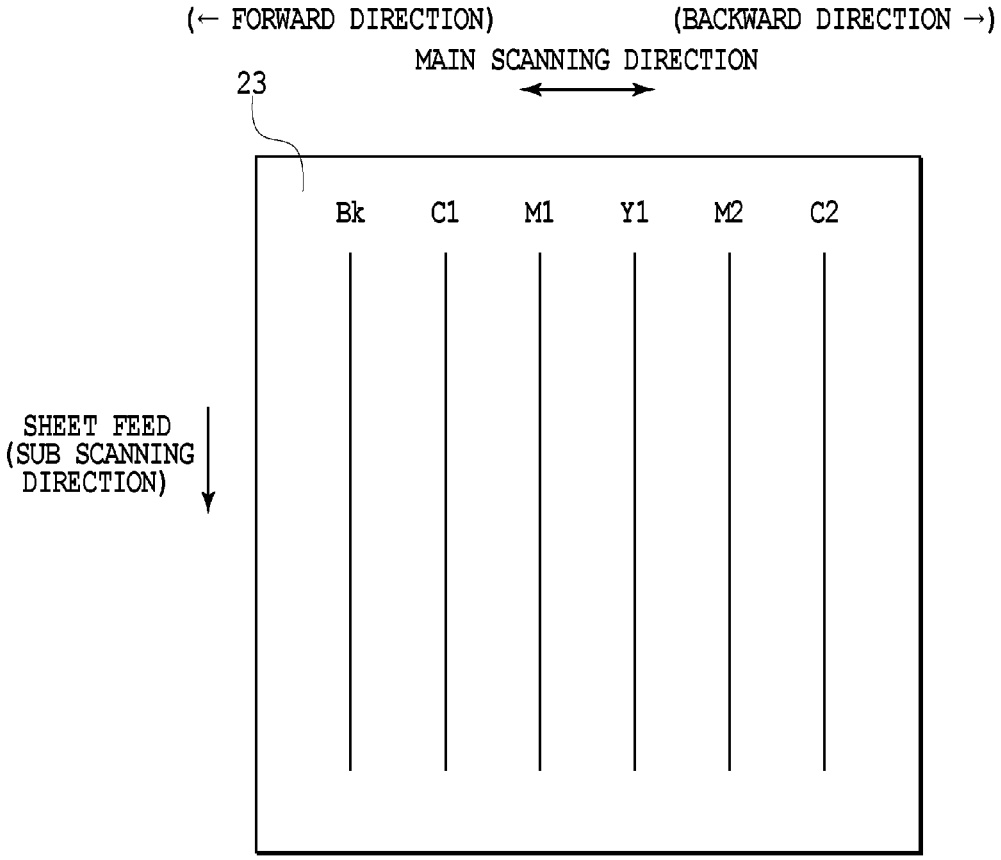
FIG. 7 is a diagram illustrating an example of the arrangement of a nozzle array when the print head in FIG. 2 is viewed from the surface of the ejection ports.

FIG. 7 is a diagram for explaining an example of an ink set of nozzle arrays in the case of viewing the print head 3 from the ejection port surface 23. As illustrated in FIG. 7, ink colors are arranged from the left in the order black, cyan, magenta, yellow, magenta and cyan. The ink colors cyan and magenta are arranged with left-right symmetry in the main scanning direction. When performing printing with this kind of arrangement, it is possible to apply ink to the printing medium in the same order when scanning in either the forward direction or backward direction of the carriage. Therefore, there is no difference in the color due to the order that ink is applied between an image printed during forward scanning and an image printed during backward scanning, so that a color image can be output at high speed.

Figure 8:
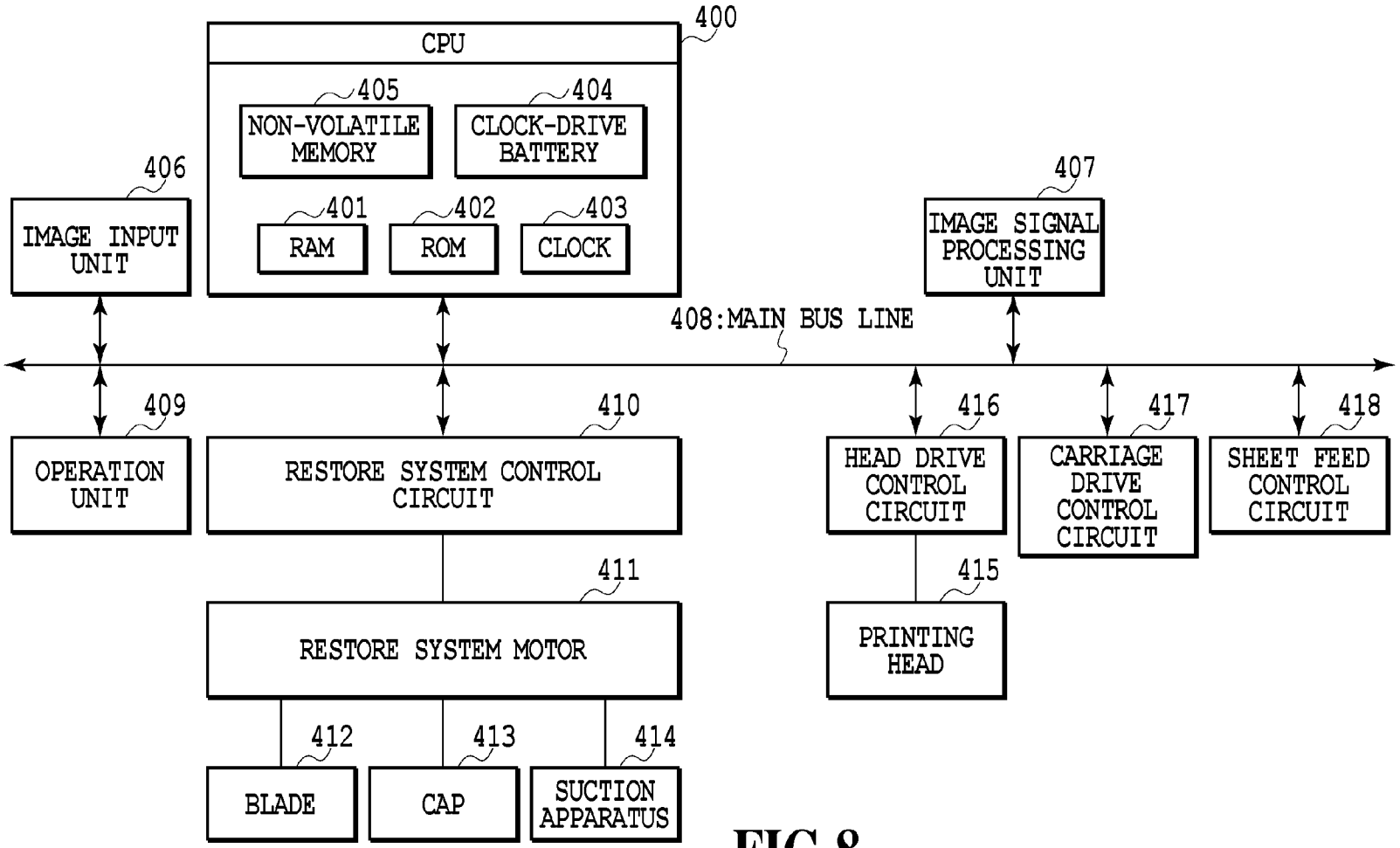
FIG. 8 is a block diagram illustrating the electrical construction of the printing apparatus of an embodiment of the present invention.

FIG. 8 is a block diagram illustrating the electrical construction of the printing apparatus of this embodiment. A CPU 400 controls each unit of the apparatus via a main bus line 408, and executes signal processing. In other words, the CPU 400 performs signal processing and controls driving of the head and driving of the carriage by the components described below according to a program stored in a ROM 401. A RAM 402 is used by the CPU 400 as a work area for signal processing and the like, and in addition to these memories there is a hard disk or the like. Moreover, the CPU 400 comprises a clock 403 for measuring the amount of time that has elapsed after the suction pump that is provided in the suction mechanism inside the eject restore apparatus 10 begins to be operated. Furthermore, the CPU 400 comprises a clock battery 405 for operating the clock 403, and non-volatile memory 405 (NVRAM) such as EPROM, EEPROM, FeRAM and the like for stored values measured by the clock 403. The clock 403 is backed up by the clock-drive battery 404, so regardless of whether or not the power to the printing apparatus 1 is ON, the clock 403 is always measuring time. This clock 403 is reset and started at specified timing as will be described later, and measures the time that elapses from the time that the clock 403 is reset to '0'. An image input unit 406 has an interface with a host device, and temporarily stores an image that has been inputted from the host device. An image signal processing unit 407 executes signal processing such as color conversion, binarization, and the like.

An operation unit 409 comprises keys and the like, which makes control input by a user using this possible. A restore system control circuit 410 controls the restore operation such as preliminary eject according to the restore process program that is stored in the RAM. 402. In other words, a restore system motor 411 drives the print head 415, the cleaning blade 412 and cap 413 that face and are separated from the print head, and a suction apparatus 414. Moreover, a head drive control circuit 416 controls driving of the electrothermal converter for the ink eject of the print head 415, and normally causes the print head 415 to perform preliminary eject and ink eject for printing. Furthermore, a carriage drive control circuit 417 and paper feed control circuit 418 similarly control movement of the carriage and paper feed according to programs.

In the following, operation control of the restore mechanism according to the ink-filled condition inside the head at the factory of the print head 3 is explained, however, that control is achieved from the background described below.

Embodiment 1

In this embodiment, with the object of improving operability by a wide range of users, control is performed with the print head 3 already installed in the carriage 2 at the production factory prior to shipment of the printing apparatus 1. When shipping is performed with the ink and solvent already filled in the print head 3, various problems could occur such as fluid leaking due to changes in surroundings or vibration, leaked fluid adhering to orifice walls, damage to orifice walls when the leaked fluid is dried, change in quality, precipitation, coagulation of the fluid due to changes in surroundings or changes over time and the like. Therefore, shipping is performed with the inside of the print head 3 in a dried empty state without filling the head with ink for shipping. Moreover, the ink cartridge 6 is not installed in the print head 3, and is separately packaged and placed together with the printing apparatus in a specified product box.

The user installs the ink cartridge 6 in the print head 3 and performs suction. When doing this, the inner wall section in a nozzle and ink flow path is near the center of the cross section with respect to the direction of ink flow in the nozzle and ink flow path, and the ink and wettability in the ink chamber inside the inkjet head becomes poor and the contact angle becomes large when compared with the so-called inside, so the flow of ink becomes slow. Therefore, in the inner wall section, there are locations where the ink flow is hindered by adhering matter and there is not sufficient ink, or there are locations where there is remaining air in the space between connecting parts and ink cannot enter. These locations become the cause of minute air bubbles being generated in the inner wall section. When trying to remove locations where there is no ink when filling the ink, it is possible to improve the speed of flow of ink in areas near the inner wall section by increasing suction or pressure when pressure is used. However, in this case, there is the chance that together with ink from the ink storage side, air will also be taken in at the same time, so that it is not possible to increase the pressure too much. Therefore, there is a proper range for the pressure used when filling the ink, and this is the same as the suction pressure conditions during suction restore. When the printing apparatus is used for the first time, creating a state in which all of the air bubbles are completely removed from the nozzles and ink flow paths is difficult, and having minute air bubbles remaining is unavoidable.

In a state with minute air bubbles remaining, phenomena such as the remaining air bubbles dissolving into the ink over time after that, the remaining air bubbles combining with each other, the remaining air bubbles combining with gas that has permeated over time and the like gradually occur, and minute groups of gas bubbles become larger. Therefore, it is necessary to perform suction and remove the air bubbles. After that, as time elapses with solids and fluids in a state of contact, the wettability of the fluid at that boundary improves. This similarly occurs on the inner walls of nozzles and ink paths, and as the wettability improves, the air bubbles that remained on the inner walls gradually move away more easily from the inner walls. Therefore, when compared with the initial state after shipping, the growth rate of air bubbles slows, so that it is possible to extend the interval between performing suction when compared with the interval at the time of shipping.

On the other hand, when there appears to be trouble with the print head such as no eject due to poor foaming because of matter or excessive eject, a new print head can be shipped from the factory, and by the user replacing the head and performing suction, the printing apparatus once again is able to print. At this time, when only a print head unit is shipped, there is a possibility that foreign matter will have adhered to the ejection port surface during transport, and that eject will not be possible, so a protective cap that covers the ejection port surface is attached, after which the print head is placed in a sealed bag and shipped. By further sealing the print head, it is becomes possible to ship the print head with ink for transport filled inside the print head, and to deliver a print head to the user having good wettability inside, so that the growth rate of air bubbles after the initial suction has been performed for the replaced print head 3 is slow from the beginning. Therefore, by performing suction when replacing the head so that it is possible to replace the ink for transport with printing ink in the initial suction, it is possible from the beginning to increase the interval between performing suction after that initial suction. The ink that is used as ink for transport is ink that, when compared with printing ink, has, as possible, less easily adhering matter than what is in printing ink, has reduced moisture ratio in order to suppress moisture loss, and has an increased solvent component. By filling the inside of the head with ink for transport, it becomes easier to keep the print head in a state in which good printing performance is obtainable even when transporting or storing the entire printing apparatus.

From the phenomena above, it is possible divide control of the operation of the suction restore mechanism into the cases described below according to the state of filling ink inside the head at the factory. When shipping the printing apparatus with the print head already installed, the printing apparatus is shipped with the inside of the head dry. Therefore, immediately after the head has been filled with ink, removal of air bubbles is difficult even when suction restore is repeated, and furthermore, the initial growth rate of air bubbles is fast. Consequently, it is necessary to shorten the timer suction interval, and to perform strong suction in order to remove the air bubbles. After a certain amount of time has elapsed, the growth rate of air bubbles in the ink becomes slower than after initial suction. In other words, it becomes possible to extend the time interval for performing timer suction. That is, when suction restore is performed after the initial air bubble growth, the minute air bubbles that are the nucleus of air bubble growth nearly cease to exist in the nozzles and ink flow paths, so even when the atmospheric air has permeated through the walls of the component members, the amount of time until there is an amount of air bubbles that will cause the eject to be poor becomes long. On the other hand, when replacing the head, the head is shipped with ink-filled into the head, so that by being able to replace the ink for transport with printing ink, the growth rate of air bubbles due to filling the ink is initially slow, so it is possible to extend the timer suction interval from that of the initial stage. Timer suction is a suction restore operation that is performed automatically after a specified amount of time has elapsed.

Figure 1:
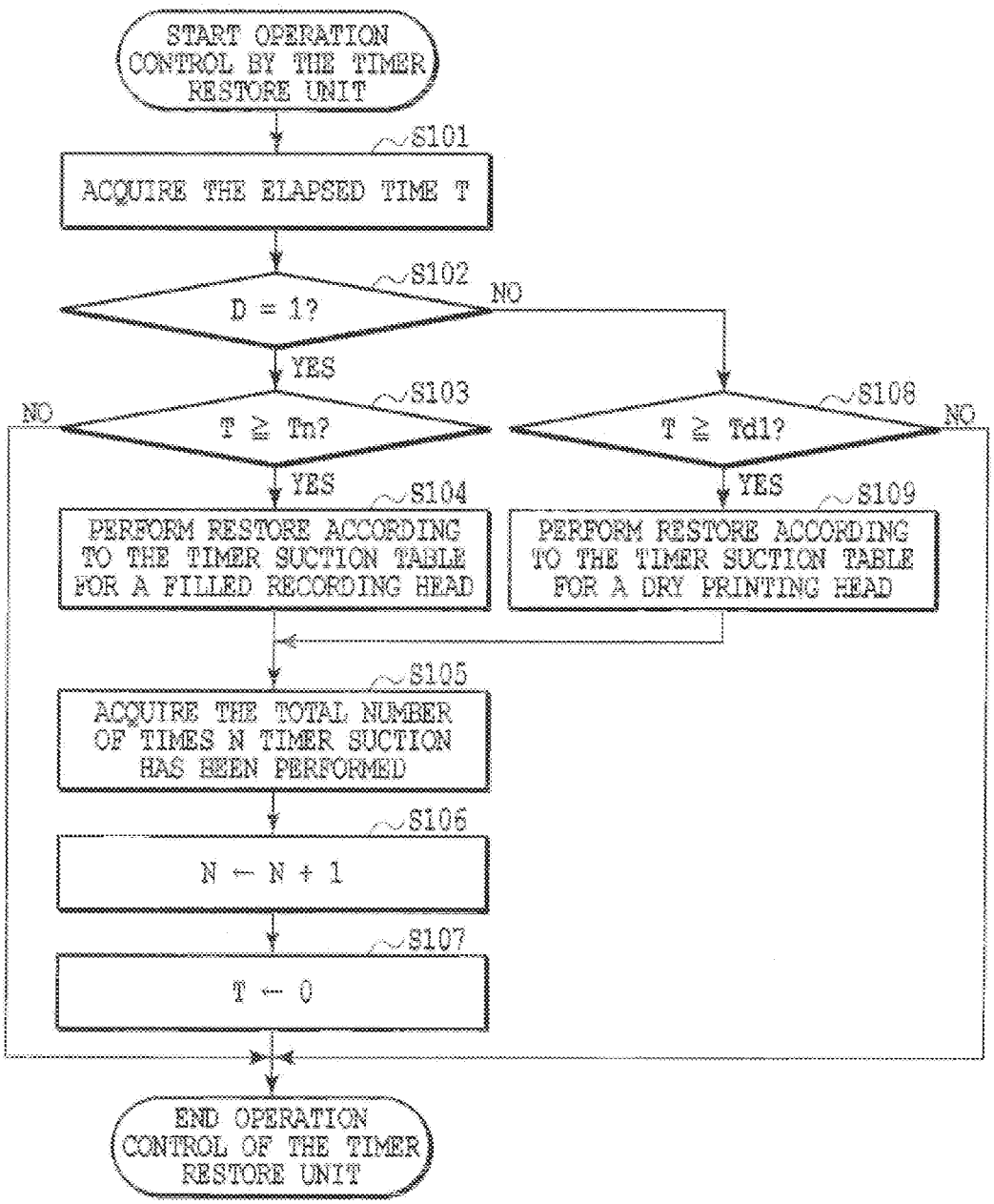
FIG. 1 is a flowchart illustrating operation control by a restore mechanism of a first embodiment of the present invention.

In the following, the control of operation of the suction restore mechanism will be explained in detail according to the ink-filled condition inside the head at the time of shipping from the factory. Here, the ink-filled condition is a parameter that has an effect on the growth rate of air bubbles that exist inside the print head that is filled with ink. As described above, the print head 3 at the time the printing apparatus is shipped is dry; however, when replacing the print head 3, the print head 3 is shipped with ink-filled inside the head, so the initial growth rate of air bubbles after filling the head the first time with printing ink is different. Based on this characteristic, the methods for controlling the operation of the suction restore mechanism of the eject restore apparatus 10 that is installed in the printing apparatus 1, which differ according to the ink-filled condition at the time the print head is shipped, will be explained. FIG. 1 illustrates a flowchart for explaining the flow of this control, and FIG. 9, FIG. 10, FIG. 11 and FIG. 12 illustrate tables that are referenced when performing control.

When an image signal for printing is sent to the printing apparatus 1, the restore mechanism moves to the sequence illustrated in FIG. 1 before ink is ejected by the head cartridge 6. Here, first, the restore mechanism advances to step S101 and acquires the time T that has elapsed since the previous suction operation up to the present time from a value stored in the non-volatile memory 405. In step S102, the restore mechanism selects the type of operation control of the restore mechanism according to the value of an ink filling flag D at the time of shipping that is written in the non-volatile memory area of the print head 3 beforehand. FIG. 9 is an ink filling judgment table at the time of shipping of the print head. According to FIG. 9, the flag is set to D=1 when ink is filled in the print head and shipped, and the flag is set to D=0 when the print head is dried and then shipped. When D=1, the restore mechanism advances to step S103. On the other hand, when D=0, the restore mechanism advances to step S108. By doing so, it is possible to make the operation control of the restore suction mechanism differ according to the ink-filled condition at the time of shipping of the print head.

In step S102, when D=1, or in other words, when ink is filled in the print head at the time of shipping, the restore mechanism advances to step S103. In step S103, the restore mechanism compares the time T that has elapsed since the previous suction with a set time Tn for performing suction of the filled print head. FIG. 10 is a table indicating the type of suction for an ink-filled print head. In this example, when a filled print head is shipped, the print head is shipped with the initial setting value for the total number of times suction has been performed being N=0. According to the table in FIG. 10, when N=0, the set time Tn is 0 hours. Therefore, at the time of delivery, T=0, so the restore mechanism advances to step S104. In the case where N=1, time is set to Tn=240 hours. For example, when T=200 hours, T≥Tn will not occur, so the restore mechanism ends control without performing the restore operation.

In step S104, in an example of performing the restore operation according to the table in FIG. 10 at delivery where N=0, so suction type Fn is selected. Also, type A is selected when N≥1. Each suction type will be explained in detail later using FIG. 12. Here, it is immediately after suction restore has been performed, so the value N that indicates the total number of times suction restore has been performed is updated, and it is necessary to reset the time that has elapsed since suction restore. Therefore, in step S105, the restore mechanism acquires the total number or times N that timer suction has been performed. Next, the restore mechanism advances to step S106, adds 1 to update the value of N that was obtained, and stores the updated value in the non-volatile memory 405. Continuing, in step S107, the restore mechanism sets the time elapsed since the suction restore operation was performed to 0, stores that value in the non-volatile memory 405 and ends this control.

On the other hand, in step S102, when D=0, or in other words, when the ink in the print head is dried at the time of shipping, the restore mechanism advances to step S108. In step S108, the restore mechanism compares the time T that has elapsed since the previous suction with the set time Td1 for performing suction of the print head with dry ink. FIG. 11 is a table indicating the suction type for a print head with dry ink. In this example, even in the case of shipping a dry print head, shipping is performed with the initial set value for the total number of times suction has been performed being N=0. According to the table in FIG. 11, when N=0, the set time Td1 is 0 hours. Therefore, at the time of delivery, the amount of time that has elapsed for the unit is 0 hours or greater, so that T≥Td1, and the restore mechanism advances to step S109. When N=1, the time Td1 is set to Td1=24 hours. For example, when T=200 hours, for the filled print head Tn=240 hours, so that T≤Tn and the restore mechanism ends this control without performing the restore operation. However, in the case of a dry print head, T>Td1, so the restore operation advances to step S109 and the restore operation is performed. Therefore, in this embodiment it is possible to provide the most suitable timer suction interval according to the ink-filled condition at factory shipment.

In step S109, the restore operation is performed according to the table in FIG. 11. In this example, at the time of delivery N=0, so the suction type Fd1 is selected. When N=1 to 5, the suction type G is selected, and when N≥6, the suction type A is selected. As in the case above, details about each suction type will be described in detail later using FIG. 12. In the filled print head above, when N=0, the suction type Fn was selected, and when N≥1 the suction type A was selected. Therefore, in this embodiment it becomes possible to provide the most suitable suction type for timer suction according to the ink-filled condition at the time of shipping. After step S109 ends, as in the case above, the restore mechanism advances to step S105, step S106 and step S107 and ends this control.

Here, the suction types in FIG. 12 mentioned above will be explained. First, the suction mechanism 48 in the restore apparatus described above is used to generate a negative pressure and perform suction, and, when doing that, it is possible to increase the negative pressure and increase the amount of suction in accordance with the total number of revolutions and the rotational speed of the PG motor M3 of the restore apparatus 10. Generally, the more the total number of revolutions of the motor is increased, the more the amount of suction increases, and the faster the rotational speed is, the higher the negative pressure can be increased. The unit of the numerical values is the number of slits of the cam 38 (slit) for the rotational speed, such that the rotational speed is defined as the number of slits moved per second (slits per sec). Moreover, by performing the rotation operation of the motor a plurality of times, it is possible to further increase the amount of suction and release the air bubbles.

In this embodiment, for the suction type Fn that is performed at the time of delivery of a print head that is shipped with the print head filled, the number of rotations of the PG motor is 3000, the rotational speed of the PG motor is 1500, and the number of times suction is performed is 3. The object of suction is to replace the ink for transport with printing ink, so when compared with Fd1, the amount of suction can be less; however, suction at the time of delivery is taken to be performed 3 times in order to prevent bad printing as much as possible. On the other hand, Fd1 is taken to be the suction type that is performed at the time of delivery when the print head is shipped in the dry state, the number of rotations of the PG motor is taken to be 5000, the rotational speed of the PG motor is taken to be 2500 and the number of times suction is performed is taken to be 3. These parameters are designed with the object of improving the initial filling of ink and to improve familiarity by performing suction a plurality of times.

Furthermore, for the suction type G1 for initial air bubble growth of a print head that is shipped in the dry state, the number of rotations of the PG motor is taken to be 3000, the rotational speed of the PG motor is taken to be 1500 and the number of times that suction is performed is taken to be 2. The air bubbles that occurred inside the head must be removed, so the amount of suction is not as strong as that when the head is delivered, however, should be greater than the normal amount of suction in suction type A. As the wettability improves, it becomes easier for air bubbles that remain on the inner wall to gradually move away from the inner walls. Therefore, when compared with the initial state after shipping, the growth rate of air bubbles becomes slower, so the interval between performing suction can be increased. For the type of suction A that is performed at that time, the number of rotations of the PG motor is taken to be 1000, the rotational speed of the PG motor is taken to be 1000, and the number of times that suction is performed is taken to be 1.

These numerical values are only one example, and the most suitable values must be set according to the inner diameter of the suction tubes 32 of the restore apparatus 10, the slit interval of the cam, the shape of the cap 35, the number of ejection ports 29, number of common fluid chambers 50 and shape of fluid paths 51 in the print head 3, the type of ink that is stored in the ink cartridge, the time interval between each time of timer suction, and the like.

By selecting the suction interval of suction at the time of delivery and timer suction and the suction type, it is possible to perform suitable operation control of the suction mechanism that corresponds to the different speeds of growth of air bubbles that occur due to the ink-filled condition inside the head at the factory at the time of shipping. In this embodiment, a dry head is shipped when shipping the main printing unit, and when replacing the head, ink is filled in the head. However, the case of shipping a print head that is filled with ink when shipping the printing apparatus, and the case of shipping a dry print head when replacing the print head is also feasible. In such cases as well, it is possible to perform suitable operation control of the suction mechanism that corresponds to the different speeds of air bubble growth that occur due to the ink-filled condition inside the head at the time the head is shipped.

Embodiment 2

The first embodiment optimized the timer suction operation to correspond to differences in the speed of air bubble growth caused by the ink-filled condition inside the head at the factory at the time of shipping. However, it is difficult for the printing apparatus to always know the surrounding temperature when not in use. When the surrounding temperature of a dry print head in the initial stage has become extremely high, there is a possibility that the amount of air bubble growth will become the same in a shorter number of days than the specified timer suction interval as in the case after the number of days has elapsed when suction is to be performed. The frequency at which this phenomenon occurs particularly increases during the initial air bubble growth period after shipping a dry print head.

When this happens, poor eject occurs when printing, and the user must restore that poor printing, so that the restore operation must be performed manually. In the following, the suction restore operation that is activated by the user is called manual suction. Normally, for manual suction there is often a plurality of kinds of conditions that are prepared, and there is a difference between the objective of weak manual suction and strong manual suction. Weak manual suction corresponds to a small number of poor ejects, and the object is to remove bubbles in the nozzles or to remove matter, adhered ink or the like that has adhered to the ejection port surface, so only a small amount of suction is used. On the other hand, in strong manual suction, there is a large amount of suction, and there is a large amount of ink that is discarded. Therefore, it is expected that the user will first perform weak suction more often. Even in weak manual suction, suction of ink occurs, however, often parameters for a weak air bubble removal force are assigned, so that even when it is possible to restore full eject immediately after suction, there is a possibility that not all of the air bubbles can be removed, and with this as a cause, there is a high possibility that poor eject could occur again in a few hours due to air bubble growth. Therefore, in this embodiment, the air bubble removal force of manual suction is improved for the initial air bubble growth period of a dry print head. As a result, the frequency that poor eject will occur after a few days after performing manual suction during the air bubble growth period is decreased.

Figure 13:
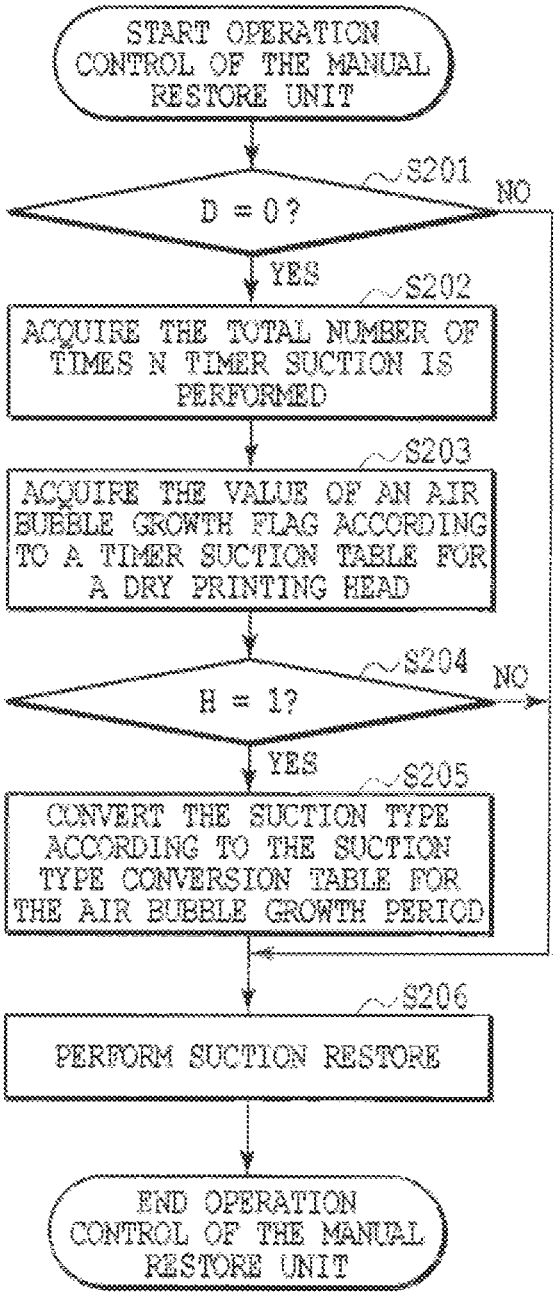
FIG. 13 is a flowchart illustrating a process for strengthening manual suction during the initial bubble growth period of a dry print head of a second embodiment of the present invention.

In the following, control for strengthening manual suction in the initial air bubble growth period according to the ink-filled condition inside the head at the time of shipment from the factory will be explained in detail. As described above, in manual suction during the initial air bubble growth period of a dry head, it is easy for poor eject to occur again. Based on such a characteristic, a method for strengthening manual suction during the initial air bubble growth period of a dry head is explained. FIG. 13 is a flowchart explaining the flow of this control, and FIG. 14 and FIG. 15 are tables that are referenced during control for strengthening manual suction.

When a signal is sent to the printing apparatus 1 for the user to perform manual suction, the restore mechanism moves to the sequence illustrated in FIG. 13. Here, the restore mechanism first advances to step S201 and selects the strength of the manual suction during the initial air bubble growth period of a dry head according to the value of an ink filling flag D at the time of shipping that is written beforehand in the non-volatile memory area of the print head 3. As described above using FIG. 9, when the print head 3 is filled before shipping, D is set to D=1, and when the ink is dried before shipping the head, D is set to D=0, after which the head is shipped. When D=0, the restore mechanism advances to step S202, and when D=1, advances to step S206.

In step S202, the restore mechanism acquires the total number of times N that timer suction has been performed. Then, in step S203, according to the table of air bubble growth periods for a dry print head in FIG. 14, the restore mechanism acquires the value of the air growth flag according to the total number of times N that timer suction has been performed. When the number of times N that timer suction has been performed for a dry print head is N=0 to 5, H=1 is selected, and when N≥6, H=0 is selected. By doing so, it is possible to establish an air bubble growth period flag for the initial air bubble growth period of a dry head when the number of times that timer suction has been performed is N=0 to 5, and to not establish a flag when N≥6 times, or in other words, after the air bubble growth period has ended. Furthermore, in step S204, when the air bubble growth period flag is H=0, the restore mechanism advances to step S206. On the other hand, when H=1, the restore mechanism advances to step S205.

In step S205, the type of suction is converted according to the suction type conversion table for the initial air bubble growth period in FIG. 15. According to FIG. 15, for strong manual suction the suction type is the same before and after conversion, and is maintained as suction type Fd1; however, when weak manual suction is selected, the suction type is converted from A to G1. As was described above using FIG. 12, suction type G1 has a higher rotational speed, a larger number of rotations, and suction is performed a larger number of times than suction type A, so that it can be confirmed that it is a suction type having a high air bubble removal force. In step S206, manual suction restore is performed and this control ends.

In this embodiment, it is possible to strengthen the manual suction during the initial air bubble growth period according to the ink-filled condition inside the head at the time of shipment from the factory. More specifically, during a period in which the timer suction interval of a dry print head is relatively short and the suction type of the timer suction is relatively strong, the strength of the weak type of manual suction is changed. By doing so, it is possible to improve printing quality after manual suction even during the air bubble growth period of a dry head. On the other hand, during normal operation after air bubble growth has become slow, it is possible to reduce the amount of ink that is consumed through suction.

Embodiment 3

In the first embodiment, the suction restore operation was optimized to correspond to differences in the speed of air bubble growth due to the ink-filled condition inside the print head at the time of shipment from the factory. The ink-filled condition inside the print head at the time of shipment from the factory was defined only for a dry print head. However, with the objective of reducing cost and improving quality when manufacturing a dry print head, the drying process during manufacturing and the form of transportation after manufacturing may change. As this happens, the wettability inside the dry print head changes, so that filling of the head with ink by suction at the time delivery that is performed by the user may be insufficient, and the speed of air bubble growth after that may differ. Therefore, it is necessary to control the operation of the suction restore mechanism according to the drying process and form of transportation of a dry print head.

In the following, control of the operation of the suction restore mechanism according to differences in the manufacturing process and form of transportation of the print head will be explained. As an example, in the manufacturing process of a print head, there is a process of drying the inside of the print head, however, with the object of reducing the manufacturing time of the print head, the drying time is changed from 20 seconds to 10 seconds. As a result, wettability inside the print head is improved, it is possible to reduce the amount of ink to be filled in the print head after the print head has been delivered, and air bubble growth after that is reduced. Based on such characteristics, operation control of the suction restore mechanism of the eject restore apparatus 10 that is installed in the printing apparatus 1 is changed to correspond to the case in which the manufacturing method and form of transportation of the print head differs. In order to accomplish this, the branches for step S102 in the sequence illustrated in FIG. 1 of the first embodiment can be further increased.

More specifically, in the manufacturing process of a print head, when the processing time for drying the inside of the print head is 20 seconds, D is taken to be D=0, and when the processing time is 10 seconds, D is taken to be D=2; that value is then written in the non-volatile memory of the print head 3 and the head is shipped. In the printing apparatus 1, in step S102 of the sequence in FIG. 1, a new branch can be provided when D=2 is selected. Here, FIG. 16 is a table indicating the suction for a dry print head when the manufacturing process and form of transportation are different. When performing processing that is the same as step S108, the time is rewritten from Td1 to Td2, and when performing processing that is the same as step S109, the restore operation is performed based on the table in FIG. 16. By executing the sequence in FIG. 1 as described above, operation changes and it is possible to optimize operation of the suction restore mechanism to correspond to the manufacturing process and form of transportation of the print head.

Embodiment 4

In the second embodiment, the strength of manual suction during periods in which the speed of air bubble growth is relatively fast was optimized according to the number of times that the suction restore operation was performed. In this case as well, as in the third embodiment, when the drying process during manufacturing and the form of transportation after manufacturing change, it is possible to correspondingly change the suction strength. FIG. 17 is a suction type conversion table for the initial air bubble growth period for the case in which the manufacturing processes and the forms of transportation differ. By executing the sequence in FIG. 13 based on the tables in FIG. 16 and FIG. 17, the operation of step S203, step S204 and step S205 changes. Furthermore, in the conversion process of step S205, by using the table illustrated in FIG. 17, it becomes possible to change the suction type after conversion to correspond to the flag at the time shipping. By performing the processing above, it is possible to optimize the strength of manual suction according to the manufacturing process and form of transportation of the print head, and according to the number of times that suction is performed based on the amount of time that has elapsed since the previous suction.

In this embodiment, a head ID is written in the non-volatile memory inside the print head. Then, after the print head has been set in the printing apparatus, the head ID is written into the non-volatile memory of the printing apparatus. When a user removes and installs a print head, in the case that the ID is the same before and after the print head has been removed and installed, the number of times N that timer suction has been performed is not reset. When the ID is different, by resetting the number of times N that suction has been performed, operation control of the suction mechanism is performed to correspond to the initial air bubble growth that occurs according to the initial filled condition of the replaced print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-148077, filed Jun. 29, 2010, which is hereby incorporated by reference herein in its entirety.

What is claimed is:

1. An inkjet printing apparatus comprising:

a print head having a plurality of ejection ports for ejecting ink;

a carriage in which the print head is removably installed;

a restoring unit configured to restore ink ejection function of the print head; and a determining unit configured to determine a restoring operation to be performed by the restoring unit for the print head depending on an ink-filled condition inside the print head at factory shipment.

2. The printing apparatus according to claim 1, wherein the determining unit determines the restoring operation further depending on an amount of elapsed time that has elapsed since a previous restoring operation was performed, and a total number of times that restoring operations have been performed.

3. The printing apparatus according to claim 2, wherein the restoring unit comprises a suction mechanism that provides suction to the ejection ports of the print head, and the determining unit determines a suction operation to be performed depending on the ink-filled condition, the amount of elapsed time, and the total number of times of restoring operations, from a plurality of suction operations, the plurality of suction operations being defined by at least a total number of revolutions, a rotational speed of a motor for driving the suction mechanism, and a number of times of suction to be performed by the suction mechanism.

4. The printing apparatus according to claim 3, wherein in the case where the ink-filled condition is in a filled state, the determining unit selects a first suction operation at the start of the restoring operation, and in the case where the ink-filled condition is not in a filled state, the determining unit selects a second suction operation which has amount of suction larger than the first suction operation at the start of the restoring operation.

5. The printing apparatus according to claim 3, wherein in the case where the ink-filled condition is in a filled state, the determining unit, when the total number of times that the restoring operation has been performed is zero, determines a suction operation such that the total number of revolutions, the rotational speed, and the number of times of suction is relatively large, and when the total number of times that the restoring operation has been performed is one or greater, determines a suction operation such that the total number of revolutions, the rotational speed, and the number of times of suction is relatively small as the elapsed time exceeds a specified amount of time.

6. The printing apparatus according to claim 3, wherein in the case where the ink-filled condition is in a filled state, the determining unit, when the total number of times that the restoring operation has been performed is zero, determines a suction operation such that at least the number of times of suction to be performed is relatively large, and when the total number of times that the restoring operation has been performed is one or more times, determines a suction operation such that at least the number of times of suction to be performed is relatively small as the elapsed time exceeds a specified amount of time.

7. The printing apparatus according to claim 6, wherein the determining unit, when the total number of times that the restoring operation has been performed is one or more times, determines an interval between the suction operations and extends the interval in accordance with an increase in the total number of times that the restoring operation has been performed.

8. The printing apparatus according to claim 2, wherein the determining unit, when an activation signal for activating the restoring unit is received through a user input, determines the restoring operation depending on the ink-filled condition, the total number of times of restoring operations, and an air bubble growth period flag that is defined in accordance with the total number of times that the restoring operation has been performed.

9. The printing apparatus according to claim 1, wherein information about the ink-filled condition is stored in memory.

10. The printing apparatus according to claim 1, wherein information about the ink-filled condition includes at least one of the factory shipping process and form of distribution of the print head, besides the ink-filled condition.

11. A control method for controlling a restoring unit that restores ink ejection function of a print head, the restoring unit being applied to an inkjet printing apparatus for printing using the print head, the print head having a plurality of ejection ports for ejecting ink, comprising:

controlling the restoring unit so as to perform a restore operation depending on an ink-filled condition inside the print head at factory shipment.

12. An inkjet printing apparatus comprising:

a print head having a plurality of ejection ports for ejecting ink;

a carriage in which the print head is removably installed;

a suction unit configured to perform a suction operation for sucking ink from the ejection ports of the print head; and a control unit configured to control the suction unit such that, (i) when the print head is not filled with ink at a time of shipment and is installed in the carriage, the suction unit performs a subsequent suction operation when a first set time or greater has elapsed since the last suction operation, and, (ii) when the print head is filled with ink at the time of shipment and is installed in the carriage, the suction unit performs a subsequent suction operation when a second set time or greater has elapsed since the last suction operation, wherein the second set time is longer than the first set time.

13. The inkjet printing apparatus according to claim 12, wherein a number of revolutions of a motor for driving the suction unit in the first case is larger than that in the second case.

14. The inkjet printing apparatus according to claim 12, wherein a rotational speed of a motor for driving the suction unit in the first case is higher than that in the second case.

15. The inkjet printing apparatus according to claim 12, wherein:

the print head includes a storing unit for storing information on ink-filled condition at the time of shipment; and the control unit is configured to obtain information on the ink-filled condition inside the print head at the time of shipment from the storing unit, and to control the suction unit based on the ink-filled condition inside the print head at the time of shipment.

* * * * *